US008464538B2

(12) United States Patent
Evulet et al.

(10) Patent No.: US 8,464,538 B2
(45) Date of Patent: Jun. 18, 2013

(54) TRAPPED VORTEX COMBUSTOR AND METHOD OF OPERATING THEREOF

(75) Inventors: Andrei Tristan Evulet, Florence (IT); Gustavo Adolfo Ledezma, Bethlehem, NY (US); Corey Bourassa, Mechanicville, NY (US)

(73) Assignee: General Electric Company, Niskayuna, NY (US)

( * ) Notice: Subject to any disclaimer, the term of this patent is extended or adjusted under 35 U.S.C. 154(b) by 369 days.

(21) Appl. No.: 12/971,354

(22) Filed: Dec. 17, 2010

(65) Prior Publication Data

US 2012/0151932 A1 Jun. 21, 2012

(51) Int. Cl.
*F02C 1/00* (2006.01)
*F02G 3/00* (2006.01)

(52) U.S. Cl.
USPC ..... 60/737; 60/752; 60/740; 60/746; 60/747; 431/178; 431/242

(58) Field of Classification Search
USPC ..... 60/737, 752–760, 739–749; 431/178, 431/242
See application file for complete search history.

(56) References Cited

U.S. PATENT DOCUMENTS 5,577,378 A 11/1996 Althaus et al.
5,857,339 A * 1/1999 Roquemore et al. ..... 60/749
6,735,949 B1 * 5/2004 Haynes et al. ..... 60/746
7,003,961 B2 * 2/2006 Kendrick et al. ..... 60/776
7,225,623 B2 6/2007 Koshoffer
7,467,518 B1 12/2008 Vermeersch
7,779,866 B2 * 8/2010 Grammel et al. ..... 137/808
8,272,219 B1 * 9/2012 Johnson et al. ..... 60/746
2011/0185735 A1 * 8/2011 Snyder ..... 60/746

FOREIGN PATENT DOCUMENTS

WO 2005/008135 A2 1/2005

* cited by examiner

*Primary Examiner* — Phutthiwat Wongwian
*Assistant Examiner* — Craig Kim
(74) *Attorney, Agent, or Firm* — Richard A. DeCristofaro

(57) ABSTRACT

A trapped vortex combustor includes a trapped vortex cavity having a first surface and a second surface. A plurality of fluidic mixers are disposed circumferentially along the first surface and the second surface of the trapped vortex cavity. At least one fluidic mixer includes a first open end receiving a first fluid stream, a coanda profile in the proximity of the first open end, a fuel plenum to discharge a fuel stream over the coanda profile, and a second open end for receiving the mixture of the first fluid stream and the fuel stream and discharging the mixture of the first fluid stream and the fuel stream in the trapped vortex cavity. The coanda profile is configured to enable attachment of the fuel stream to the coanda profile to form a boundary layer of the fuel stream and, to entrain the incoming first fluid stream to the boundary layer of the fuel stream to form a mixture of the first fluid stream and the fuel stream.

21 Claims, 5 Drawing Sheets

TRAPPED VORTEX COMBUSTOR AND METHOD OF OPERATING THEREOF

BACKGROUND

The invention relates generally to combustors, and in particular to a trapped vortex combustor in a gas turbine.

In a conventional gas turbine engine, compressed air exiting from a compressor is mixed with fuel in a combustor. The mixture is combusted in the combustor to generate a high pressure, high temperature gas stream, referred to as a post combustion gas. The post combustion gas is expanded in a turbine (high pressure turbine), which converts thermal energy associated with the post combustion gas to mechanical energy that rotates a turbine shaft. The post combustion gas exits the high pressure turbine as an expanded combustion gas.

Some gas turbines deploy a reheat combustor to utilize the oxygen content in the expanded combustion gas. The expanded combustion gas is again combusted in the reheat combustor after adding additional fuel and the re-combusted expanded combustion gas is expanded in a second turbine (low pressure turbine) to generate additional power.

If the combustion process occurring in the combustor and the reheat combustor is incomplete/not efficient, the hot gases exiting from the combustor/reheat combustor will contain pollution causing elements such as partially combusted hydrocarbons, oxides of nitrogen etc. Such pollution causing elements are eventually discharged into the atmosphere after exiting from the high pressure turbine (or the low pressure turbine, if deployed). It is therefore necessary that the combustion process be efficient and complete.

Among the challenges to improve combustor efficiency include efficient mixing of fuel and air and stabilization of the resulting flame. One of the means for addressing these challenges is inclusion of a trapped vortex cavity located on the wall of the combustor. Fuel is injected into the trapped vortex cavity from certain fixed points within the cavity. A portion of the air entering the combustor (expanded combusted gas in case of a reheat combustor) is diverted towards the trapped vortex cavity, which as the name suggests, traps the portion of the air into forming a vortex. It is desirable to achieve a stable, high speed vortex, which helps in efficient mixing of the air with the fuel injected into the trapped vortex cavity. However, to achieve a stable vortex, air entering the combustor has to be accelerated to high speeds, which results in reduced gas turbine efficiency. Further, the injection of fuel from fixed points within the cavity often creates pockets of rich fuel in the vortex of air and does not achieve the desirable amount of mixing. An inefficient mixing and unstable vortex consequently results in an unstable flame, which in turn causes inefficient combustion.

It is desirable to create a stable vortex and achieve an efficient mixing of fuel and air in the trapped vortex cavity of the combustor.

BRIEF DESCRIPTION

In accordance with one exemplary embodiment of the present invention, a trapped vortex combustor is disclosed. The trapped vortex combustor includes a trapped vortex cavity having a first surface and a second surface. A plurality of fluidic mixers are disposed circumferentially along the first surface and the second surface of the trapped vortex cavity. At least one fluidic mixer includes a first open end receiving a first fluid stream, a coanda profile in the proximity of the first open end, a fuel plenum to discharge a fuel stream over the coanda profile, and a second open end for receiving the mixture of the first fluid stream and the fuel stream and discharging the mixture of the first fluid stream and the fuel stream in the trapped vortex cavity. The coanda profile is configured to enable attachment of the fuel stream to the coanda profile to form a boundary layer of the fuel stream and, to entrain the incoming first fluid stream to the boundary layer of the fuel stream to form a mixture of the first fluid stream and the fuel stream.

In accordance with another exemplary embodiment of the present invention, a method for operating a trapped vortex combustor is disclosed. The method includes splitting a fluid stream entering the trapped vortex combustor into a first fluid stream and a second fluid stream. A portion of the second fluid stream is directed to an open end of a trapped vortex cavity in the trapped vortex combustor. The first fluid stream is diverted to a plurality of fluidic mixers disposed circumferentially along a first surface and a second surface of the trapped vortex cavity. A fuel stream is discharged over a coanda profile in the proximity of a first open end of at least one fluidic mixer of the plurality of fluidic mixers so as to enable attachment of the fuel stream to the coanda profile to form a boundary layer of the fuel stream and to entrain the incoming first fluid stream to the boundary layer of the fuel stream to form a mixture of the first fluid stream and the fuel stream. The mixture including the first fluid stream and the fuel stream in the trapped vortex cavity is discharged via a second open end of the at least one fluidic mixer.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As discussed in detail below, embodiments of the present invention provide a trapped vortex combustor and method of operating thereof. This invention may, however, be embodied in many different forms and should not be construed as limited to the embodiments set forth herein; rather these embodiments are provided so that this disclosure will be thorough and complete and will fully convey the scope of the invention to those skilled in the art.

Figure 1:
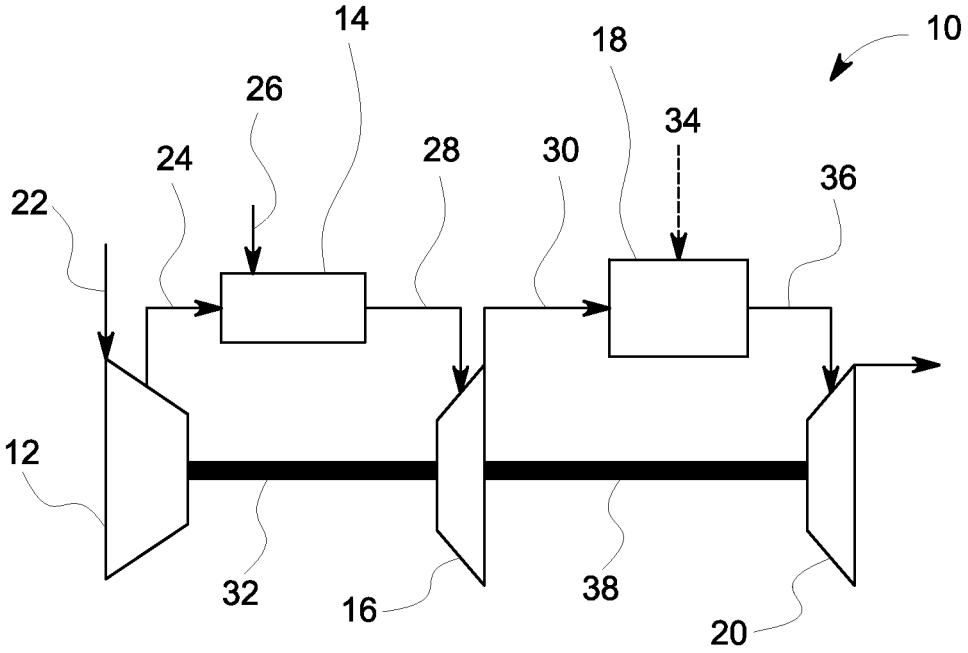
FIG. 1 illustrates a gas turbine engine in accordance with an embodiment of the invention.

FIG. 1 illustrates a gas turbine engine 10 in accordance with an embodiment of the invention. The FIG. 1 illustrates a compressor 12, a combustor 14, a first turbine 16, a reheat combustor 18, and a second turbine 20. An air stream 22 such as atmospheric air is fed into the compressor 12 for compression to the desired temperature and pressure. After compression, the air stream 22 exits the compressor 12 as a compressed air stream 24 and is mixed with a fuel stream 26 in the combustor 14. The mixture comprising the compressed air stream 24 and the fuel stream 26 is combusted in the combustor 14, resulting in a high temperature and high pressure stream of a post combustion gas 28. The post combustion gas 28 is expanded in the first turbine 16 to convert thermal energy associated with the post combustion gas 28 into mechanical energy. The post combustion gas 28 exits the first turbine 16 as an expanded combustion gas 30. According to an embodiment, the first turbine 16 is coupled to the compressor 12 via a shaft 32 and drives the compressor 12.

The expanded combustion gas 30 includes certain amount of unutilized oxygen (about 15% to about 20% by mass). Therefore, instead of releasing the expanded combustion gas 30 in the atmosphere, the gas turbine engine 10 deploys the reheat combustor 18 and the second turbine 20 to generate additional power. The expanded combustion gas 30 is mixed with a fuel stream 34 in the reheat combustor 18 and the mixture comprising the expanded combustion gas 30 and the fuel stream 34 is combusted in the reheat combustor 18. The combusted mixture exits the reheat combustor 18 as a flow 36, which is expanded in the second turbine 20. In an embodiment, the second turbine 20 is coupled to the first turbine 16 via a shaft 38.

For an efficient and complete combustion, the combustor 14 and the reheat combustor 18 include a trapped vortex cavity with a plurality of fluidic mixers disposed on the surfaces of the trapped vortex cavity. The subsequent figures illustrate the trapped vortex cavity and the plurality of fluidic mixers in greater detail with reference to the combustor 14. In certain other embodiments, a similar trapped vortex cavity and the plurality of fluidic mixtures can be deployed in the reheat combustor 18 as well. In some embodiments, both the combustor 14 and the reheat combustor 18 simultaneously include a trapped vortex cavity with a plurality of fluidic mixers disposed on the surfaces of the trapped vortex cavity.

Figure 2:
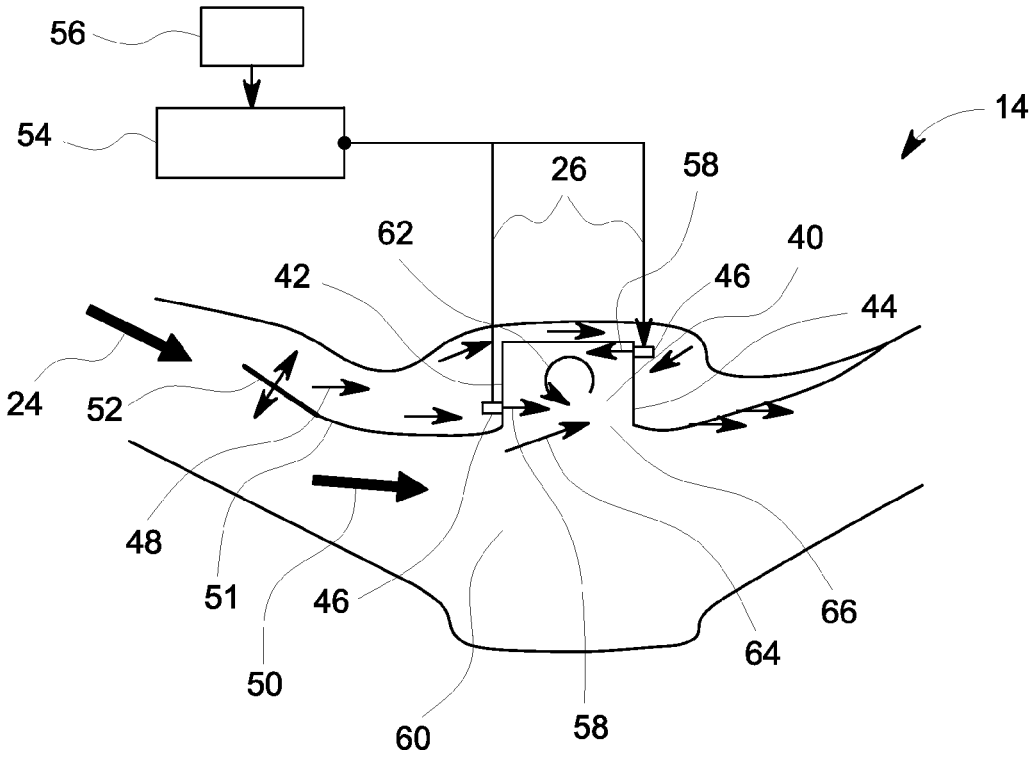
FIG. 2 illustrates a trapped vortex combustor in accordance with an embodiment of the invention.

FIG. 2 illustrates a diagrammatical representation of the combustor 14 including a trapped vortex cavity 40. As the combustor 14 includes a trapped vortex cavity 40, the combustor 14 can also be referred to as a trapped vortex combustor 14. The trapped vortex cavity 40 includes a first surface 42 and a second surface 44. The combustor 14 further includes a plurality of fluidic mixers 46 disposed on the first surface 42 and the second surface 44. The placing of the plurality of fluidic mixers 46 on the first surface 42 and the second surface 44 will be illustrated in detail in conjunction with FIG. 3. According to the illustrated exemplary embodiment, the trapped vortex cavity 40 has a rectangular cross section. In other embodiments, the trapped vortex cavity 40 may have other cross sections, such as a semi circular cross section.

After entering the combustor 14, the compressed air stream 24 (may also be referred to generically as a "fluid stream") is split into a first fluid stream 48 and a second fluid stream 50. In another embodiment with reference to the reheat combustor 18, the expanded combustion gas 30 (may also be referred to generically as a "fluid stream") is split into a first fluid stream 48 and a second fluid stream 50. The combustor 14 deploys a splitting device 52, such as a flap, for splitting the compressed air stream 24 into the first fluid stream 48 and the second fluid stream 50. According to an embodiment the splitting device 52 has an aerodynamic profile and is hinged at a location 51 upstream of the combustor 18. It should be noted the splitting device 52 as illustrated in the FIG. 2 is exemplary and other splitting devices can be deployed to split the expanded combustion gas 24 into the first fluid stream 48 and the second fluid stream 50.

The first fluid stream 48 is diverted to the fluidic mixers 46 located on the first surface 42 and the second surface 44. The fluidic mixers 46 are coupled to a fuel store 54, which supplies fuel as the fuel stream 26 to the fluidic mixers 46. A control unit 56 controls the supply of fuel from the fuel store 54 to the fluidic mixers 46. According to an embodiment, the control unit 56 controls the supply of the fuel to the fluidic mixers 46 based on a load on the trapped vortex combustor 14. The first fluid stream 48 and the fuel stream 26 are mixed in the fluidic mixers 46 and the mixture is discharged in the trapped vortex cavity 40 as a flow 58. It should be noted that the fluidic mixers 46 are configured to thoroughly mix the first fluid stream 48 and the fuel stream 26 and discharge the flow 58 in to the trapped vortex cavity 40 at a speed higher than the speed of the first fluid stream 48 entering the fluidic mixers 46. Details of the mixing of the first fluid stream 48 and the fuel stream 26 are discussed in subsequent figures. According to the illustrated embodiment, the first surface 42 and the second surface 44 are located opposite to each other. The flow 58 discharged from the fluidic mixtures 46 disposed on the surface 42 forms a vortex 62 with the flow 58 discharged from the fluidic mixtures 46 disposed on the surface 44.

The second fluid stream 50 of the compressed air stream 24 is directed towards a main chamber 60. A portion 64 of the second fluid stream 50 enters the trapped vortex cavity 40 via an open end 66. The portion 64 of the second fluid stream 50 further augments the vortex 62 formed by the flow 58 inside the trapped vortex cavity 40.

Figure 3:
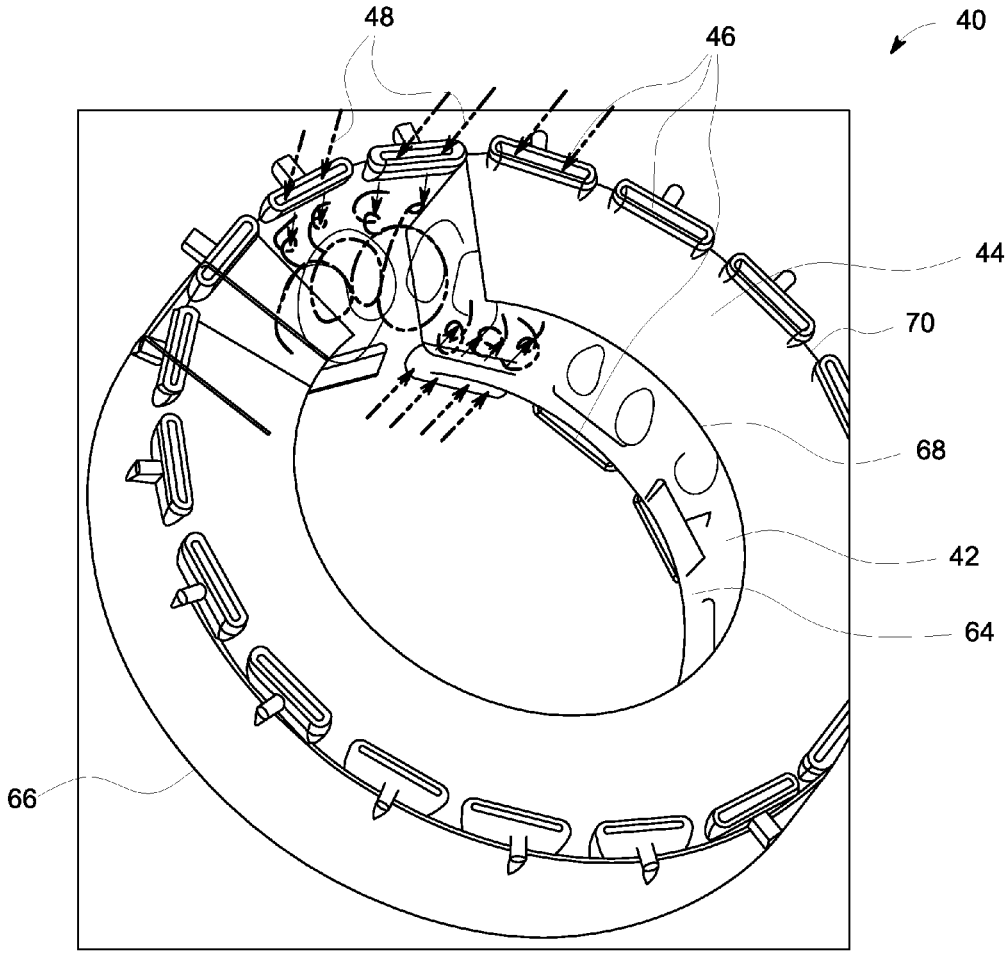
FIG. 3 illustrates a trapped vortex cavity and a plurality of fluidic mixers in a trapped vortex combustor in accordance with an embodiment of FIG. 2.

FIG. 3 illustrates a perspective view of the trapped vortex cavity 40 in accordance with an embodiment of FIG. 2. The FIG. 3 illustrates the plurality of fluidic mixers 46 disposed on the first surface 42 and the second surface 44. According to an embodiment, the first surface 42 has an inner end 64 and an outer end 66. Similarly the second surface 44 has an inner end 68 and an outer end 70. According to an embodiment, one or more fluidic mixers 46 are disposed circumferentially along the inner end 64 of the first surface 42 and one or more fluidic mixers 46 are disposed circumferentially along the outer end 70 of the second surface 44. It is to be noted that the number of fluidic mixers 46 disposed o the first surface 42 and the second surface 44 as illustrated in FIG. 3 is only exemplary. The figure further illustrates the first fluid stream 48 entering the fluidic mixer 46

Figure 4:
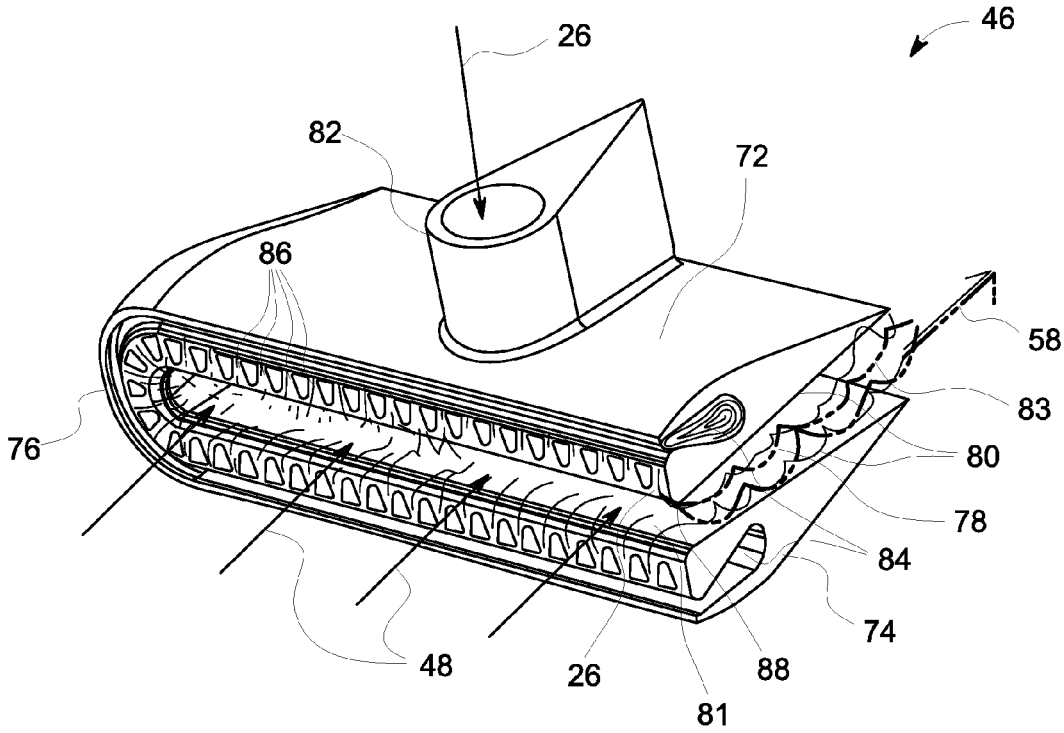
FIG. 4 illustrates a fluidic mixer in accordance with an embodiment of FIG. 2 and FIG. 3.

FIG. 4 illustrates the fluidic mixer 46 in accordance with an embodiment of FIGS. 1-3. The fluidic mixer 46 includes a first portion 72, a second portion 74, a first semicircular portion 76 and a second semicircular portion (not shown). The second semicircular portion is located opposite to the first semicircular portion 76. The first portion 72 is coupled to the second portion 74 via the first semicircular portion 76 and the second semicircular portion. The fluidic mixer 46 further includes a diffuser portion 78 having a divergent profile 80 surrounded by the first portion 72, the second portion 74, the first semicircular portion 76 and the second semicircular portion. The divergent profile 80 of the diffuser portion 78 diverges from a first open end 81 to a second open end 83. The fluidic mixer 46 further includes a fuel inlet 82, coupled to the first portion 72, for the fuel stream 26 to enter the fluidic mixer 46 from the fuel store 54 (FIG. 2). A fuel plenum 84 extends along the first portion 72, second portion 74, the first semicircular portion 76, and the second semicircular portion and temporarily stores the fuel stream 26 coming from the fuel inlet 82. In the proximity of the first open end, each of the first portion 72, the second portion 74, the first semicircular portion 76 and the second semicircular portion has a plurality of slots 86 and a coanda profile 88.

The fluidic mixer 46 receives the first fluid stream 48 via the first open end 81. The fuel plenum 84 discharges the fuel stream 26 via the plurality of slots 86 over the coanda profile 88, wherein the coanda profile 88 is configured to enable attachment of the fuel stream 26 to the coanda profile 88 to form a boundary layer of the fuel stream 26 and to entrain the incoming first fluid stream 48 to the boundary layer of the fuel stream 26 to form a mixture of the first fluid stream 48 and the fuel stream 26. According to an embodiment, the fluidic mixer 46 is configured to allow mixing of the first fluid stream 48 and the fuel stream 26 based on a "coanda effect". As used herein, the term "coanda effect" refers to the tendency of a stream of fluid to attach itself to a nearby surface and to remain attached even when the surface curves away from the original direction of fluid motion. The coanda effect will be further discussed in conjunction with FIG. 5.

The diffuser portion 72 of the fluidic mixer 46 directs the mixture of the first fluid stream 48 and the fuel stream 26 to the second open end 83. The mixture of the first fluid stream 48 and the fuel stream 26 exits the second open end 83 and is discharged into the trapped vortex cavity 40 as illustrated and discussed in conjunction with FIG. 2.

The fuel stream 26 is discharged over the coanda profile 88 from the fuel plenum 84 at a first pressure and the first open end 81 receives the first fluid stream 48 at a second pressure. In an embodiment, the first pressure is higher than the second pressure. The high pressure discharge of the fuel stream 26 accelerates the first fluid stream 48 and therefore the flow 58 is discharged into the trapped vortex cavity 40 at a speed higher than the speed of the first fluid stream 48 entering the fluidic mixers 46. It is to be noted that discharging of the flow 58 in the trapped vortex cavity 40 at high speeds results increases the stability of the vortex 62 (FIG. 2).

In reference to both FIGS. 2 and 4, process of using the high pressure fuel discharge in a fluidic mixer 46 so as to increase the fuel air mixing and the speed of flow 58 into the trapped vortex cavity 40 is referred to as "energizing" of the fluidic mixer 46. Using the control unit 56, one or more fluidic mixers can be selectively energized depending on the load requirements of the combustor 14.

Figure 5:
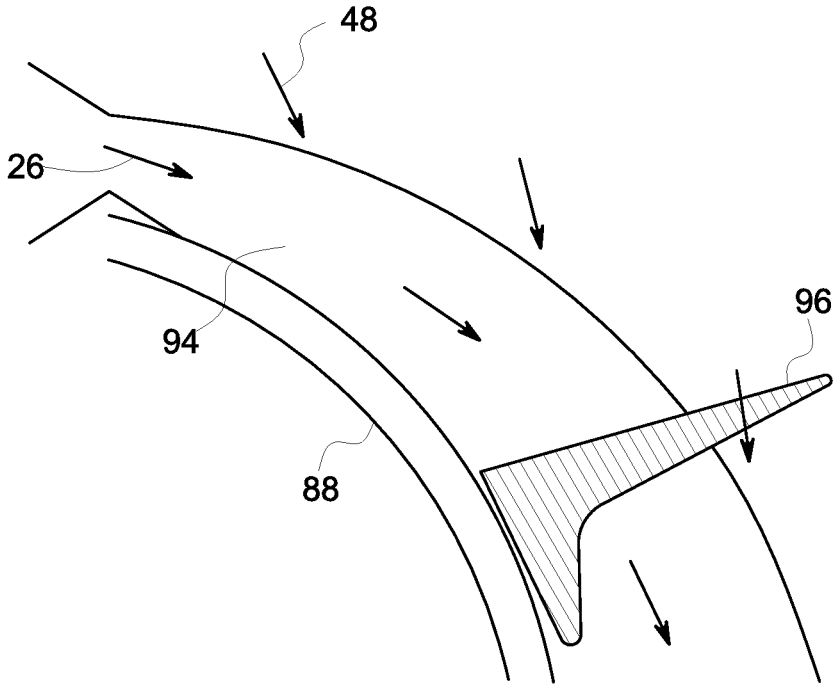
FIG. 5 illustrates of the formation of a fuel boundary layer adjacent the coanda profile in the fluidic mixer in accordance with an embodiment of FIG. 4.

FIG. 5 is a illustration of the formation of a fuel boundary layer adjacent the coanda profile 88 of the fluidic mixer 46 (illustrated in FIG. 4) in accordance with an embodiment of FIG. 4. In the illustrated embodiment, the fuel stream 26 attaches to the coanda profile 88 and remains attached even when the surface of the coanda profile 88 curves away from the initial fuel flow direction. More specifically, as the fuel stream 26 accelerates to balance the momentum transfer, there is a pressure difference across the flow, which deflects the fuel stream 26 closer to the surface of the coanda profile 88. As the fuel stream 26 moves across the coanda profile 88, a certain amount of skin friction occurs between the fuel stream 26 and the coanda profile 88. The resistance from the skin friction to the flow deflects the fuel stream 26 towards the coanda profile 88 thereby causing the fuel stream 26 to stick to the coanda profile 88. Further, a boundary layer 94 of the fuel stream 26 formed by the coanda effect entrains the first fluid flow 48 to form a shear layer 96 with the boundary layer 94 to promote mixing of the first fluid flow 48 and the fuel stream 26. Furthermore, the shear layer 96 formed by the detachment and mixing of the boundary layer 94 with the first fluid flow 48 results in a uniform mixture.

More details pertaining to coanda devices are explained in greater detail with reference to U.S. application Ser. No. 11/273,212 incorporated herein by reference.

In reference to FIGS. 1-5, the use of a high pressure fuel flow results in a high speed fuel air mixture entering the trapped vortex cavity. The high speed fuel air mixture causes a stable vortex and stabilization of the resulting flame.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A trapped vortex combustor, comprising:

a trapped vortex cavity comprising a first surface and a second surface;

a plurality of fluidic mixers disposed circumferentially along the first surface and the second surface of the trapped vortex cavity, wherein at least one fluidic mixer comprises:

a first open end receiving a first fluid stream;

a coanda profile in the proximity of the first open end;

a fuel plenum to discharge a fuel stream over the coanda profile, wherein the coanda profile is configured to enable attachment of the fuel stream to the coanda profile to form a boundary layer of the fuel stream and, to entrain the incoming first fluid stream to the boundary layer of the fuel stream to form a mixture of the first fluid stream and the fuel stream; and a second open end for receiving the mixture of the first fluid stream and the fuel stream and discharging the mixture of the first fluid stream and the fuel stream in the trapped vortex cavity.

2. The trapped vortex combustor of claim 1, further comprising a splitting device disposed at a location upstream of the trapped vortex combustor, for splitting a fluid stream entering the trapped vortex combustor into the first fluid stream and a second fluid stream, a portion of the second fluid stream being directed to the trapped vortex cavity.

3. The trapped vortex combustor of claim 2, wherein the mixture of the first fluid stream and the fuel stream and the portion of the second stream forms a vortex inside the trapped vortex cavity.

4. The trapped vortex combustor of claim 2, wherein the fluid stream comprises air.

5. The trapped vortex combustor of claim 2, wherein the fluid stream comprises an expanded combustion gas.

6. The trapped vortex combustor of claim 1, wherein the first fluid stream forms a shear layer within the boundary layer of the fuel stream to enable mixing of the fuel stream and the first fluid stream.

7. The trapped vortex combustor of claim 1, wherein the fuel plenum is configured to discharge the fuel stream over the coanda profile at a first pressure and the first open end receive the first fluid stream at a second pressure, the first pressure being higher than the second pressure.

8. The trapped vortex combustor of claim 1, wherein the coanda profile deflects the fuel stream supplied through the fuel plenum towards the coanda profile via a Coanda effect.

9. The trapped vortex combustor of claim 1, wherein the at least one fluidic mixer further comprises a diffuser portion having a divergent profile for directing the mixture of the first fluid stream and the fuel stream to the second open end.

10. The trapped vortex combustor of claim 1, wherein the trapped vortex cavity has a rectangular cross-section.

11. The trapped vortex combustor of claim 1, wherein the first surface comprises an inner end and an outer end, the at least one fluidic mixer being disposed on the inner end of the first surface.

12. The trapped vortex combustor of claim 1, wherein the second surface comprises an inner end and an outer end, the at least one fluidic mixer being disposed on the outer end of the second surface.

13. The trapped vortex combustor of claim 1, further comprising a control unit configured to control supply of fuel to the fuel plenum of the at least one fluidic mixer.

14. The trapped vortex combustor of claim 13, wherein the control unit is configured to control the supply of the fuel to the fuel plenum based on a load on the trapped vortex combustor.

15. The trapped vortex combustor of claim 1, wherein the second surface is located opposite to the first surface.

16. A method for operating a trapped vortex combustor, the method comprising:

splitting a fluid stream entering the trapped vortex combustor into a first fluid stream and a second fluid stream;

directing a portion of the second fluid stream to an open end of a trapped vortex cavity in the trapped vortex combustor;

diverting the first fluid stream to a plurality of fluidic mixers disposed circumferentially along a first surface and a second surface of the trapped vortex cavity;

discharging a fuel stream over a coanda profile in the proximity of a first open end of at least one fluidic mixer of the plurality of fluidic mixers so to enable attachment of the fuel stream to the coanda profile to form a boundary layer of the fuel stream and to entrain the incoming first fluid stream to the boundary layer of the fuel stream to form a mixture of the first fluid stream and the fuel stream;

discharging the mixture comprising the first fluid stream and the fuel stream in the trapped vortex cavity via a second open end of the at least one fluidic mixer.

17. The method of claim 16, wherein discharging the mixture comprising the first fluid stream and the fuel stream in the trapped vortex cavity comprises:

discharging the mixture comprising the first fluid stream and the fuel stream in the trapped vortex cavity in the proximity of an inner end of the first surface.

18. The method of claim 16, wherein discharging the mixture comprising the first fluid stream and the fuel stream in the trapped vortex cavity comprises:

discharging the mixture comprising the first fluid stream and the fuel stream in the trapped vortex cavity in the proximity of an outer end of the second surface.

19. The method of claim 16, further comprises discharging the mixture comprising the first fluid stream and the fuel stream in the trapped vortex cavity via a second open end of the at least one fluidic mixer in such a way that the portion of the second fluid stream and the mixture comprising the first fluid stream and the fuel stream forms a vortex inside the trapped vortex cavity.

20. The method of claim 16, further comprising:

discharging the fuel stream over the coanda profile at a first pressure, diverting the first fluid stream to a plurality of fluidic mixers at a second pressure, the first pressure being higher than the second pressure.

21. The method of claim 16 further comprising, deflecting the fuel stream discharged over the coanda profile, towards the coanda profile via a Coanda effect.

* * * * *